US008342166B2

(12) United States Patent
Martin

(10) Patent No.: US 8,342,166 B2
(45) Date of Patent: Jan. 1, 2013

(54) DECORATIVE FIREPLACE SCREEN AND METHOD OF MANUFACTURE

(76) Inventor: Sherry Lou Martin, Racine, WI (US)

( * ) Notice: Subject to any disclaimer, the term of this patent is extended or adjusted under 35 U.S.C. 154(b) by 772 days.

(21) Appl. No.: 12/117,051

(22) Filed: May 8, 2008

(65) Prior Publication Data

US 2008/0276927 A1 Nov. 13, 2008

Related U.S. Application Data

(60) Provisional application No. 60/928,735, filed on May 11, 2007.

(51) Int. Cl.
*F24B 1/92* (2006.01)

(52) U.S. Cl. ..... 126/541; 126/544; 126/547; 160/371; 29/428; 428/162

(58) Field of Classification Search ..... 126/541, 126/544, 547; 160/371; 29/428; 428/162
See application file for complete search history.

(56) References Cited

U.S. PATENT DOCUMENTS 3,680,225 A * 8/1972 Ishida ..... 434/84
4,318,946 A * 3/1982 Pavone ..... 428/34
5,470,623 A * 11/1995 Lucas ..... 428/47
5,866,225 A * 2/1999 Crossley ..... 428/49
2002/0170554 A1* 11/2002 Behn ..... 126/547
2004/0031481 A1* 2/2004 Carzoli ..... 126/544

* cited by examiner

*Primary Examiner* — Steven B McAllister
*Assistant Examiner* — Avinash Savani
(74) *Attorney, Agent, or Firm* — Jansson Shupe & Munger Ltd.

(57) ABSTRACT

A decorative fireplace screen for a fireplace having a fireplace opening, and a method of manufacture therefor are disclosed. Decorative screens of the invention may also be for other purposes. The fireplace screen includes a planar main member, a decorative design applied to the front surface of the main member, a substantially clear adhesive layer over the decorative design, a design-enhancing mosaic of shattered-glass pieces adhered to the adhesive layer and substantially covering the decorative design, and grout between the shattered class pieces and securing them in place. Certain preferred embodiments are a support member along the lower edge, a frame, a foam board on the back surface of the main member to facilitate air-blocking of the fireplace. Preferred decorative features are glitter selectively applied over the design and use of a substantially transparent material as the main member.

24 Claims, 9 Drawing Sheets

DECORATIVE FIREPLACE SCREEN AND METHOD OF MANUFACTURE

RELATED APPLICATION

This application claims the benefit of U.S. Provisional Application No. 60/928,735 filed on May 11, 2007, the contents of which is incorporated by reference herein in its entirety.

FIELD OF THE INVENTION

This invention relates to fireplace screens and to decorative screens for other purposes.

BACKGROUND OF THE INVENTION

Wood-burning fireplaces within houses and other buildings are nearly as old as houses and buildings themselves and serve both functional and aesthetic purposes. With the rise of modern central heating systems, fireplaces have more and more become things that are primarily of aesthetic concern only. Indeed, many homes that include fireplaces typically make little use of them even in winter, despite the fact that they provide two types of warmth and comfort—physical warmth and comfort to those nearby and the psychological warmth and comfort associated with innumerable memories and stories of family gatherings "by the fireplace"—and President Roosevelt's famous "fireside chats."

But functional fireplaces also involve the attendant well-known problems of preventing heat loss up the chimney, particularly when the fireplace is not in use. And, since fireplaces in homes are often considered visual focal points for the rooms they serve, the matter of the appearance of a fireplace is often also a primary concern.

It is to these fireplace-related problems and concerns that the present invention is directed.

Decorative screens are used for a wide variety of other purposes, such as to provide a degree of privacy or to cover interior or exterior openings in homes or other structures. Providing decorative screens of remarkable appearance often depends almost primarily, if not exclusively, on the artistic ability of the creating artist, and not primarily on the nature of the structure. This invention is also directed toward creation of a decorative screen of a different structural nature.

OBJECTS OF THE INVENTION

It is an object of this invention, to provide an improved decorative fireplace screen which overcomes certain problems and shortcoming of the prior art including those referred to above.

Another object of this invention is to provide an improved decorative fireplace screen which prevents heat loss up the chimney, particularly when the fireplace is not in use.

Yet another object of the invention is to provide an improved decorative fireplace screen which is aesthetically pleasing.

These and other objects of the invention will be apparent from the following descriptions and the drawings.

SUMMARY OF THE INVENTION

The invention is a decorative fireplace screen that is placed over the opening of a fireplace to serve the purpose of draft-sealing and/or decorative purposes. In its most preferred forms, the device of this invention serves multiple purposes.

Not only does it stop or significantly reduce air-leakage into (or out of) a fireplace chamber, but, due to its unique structural characteristics, has a unique decorative appearance. Furthermore, particularly preferred forms of the inventive fireplace screen that involve a transparent main layer (as described below), when in place while the fireplace is in use, create further interesting and unique visual effects. In the latter uses (and others), the inventive fireplace screen may either be right against the fireplace opening or just back from such opening. It is also preferred that the fireplace screen have a planar main member (with front and back surfaces) sized to substantially cover the fireplace opening or sized for the desired screening purpose. In preferred embodiments a decorative design is applied to the front surface and a substantially clear adhesive layer is applied onto the decorative design. Preferably a mosaic of shattered-glass pieces is adhered to the adhesive layer substantially covering the decorative design and grout is applied between the shattered glass pieces securing them in place In certain preferred embodiments the decorative screen further includes a support member along the lower edge of the main member to support the decorative screen in its placement at the fireplace opening. In highly preferred embodiments the decorative screen further includes a frame applied to the front of the main member about the edges thereof.

It is most preferred that a support member is included along the lower edge of the main member to support the decorative screen in its placement at the fireplace opening. It is highly desirable that the decorative screen further includes a foam board applied to the back surface of the main member, thereby facilitating air-blocking by covering the fireplace opening.

Preferred embodiments include glitter selectively applied with respect to the design to highlight design features or the decorative design can be painted on the front surface of the main member. In other preferred embodiments the decorative design is on a sheet applied onto the front surface of the main member.

In highly preferred embodiments the decorative design is a flame design. In other preferred embodiments the shattered glass pieces are of non-colored glass. Preferably the main member is of a substantially transparent material and is of a material selected from glass and transparent plastic materials.

It is highly preferred that the method of making a decorative fireplace screen for draft sealing of a fireplace which has a fireplace opening, includes providing a planar main member sized to substantially cover the fireplace opening, the main member has front and back surfaces; applying a decorative design to the front surface; applying a substantially clear adhesive layer applied onto the decorative design; placing shattered-glass pieces onto the adhesive layer to adhere a design-enhancing mosaic of individual glass pieces over and substantially covering the decorative design; and applying grout between the shattered glass pieces.

The term "fireplace screen" as used herein refers to a generally planar vertical sheet-like structure that is placed over a fireplace opening, rather than to a porous wire (or similar) structure the purpose of which is to allow air flow through it. No air flow is contemplated, at least with preferred embodiments of this invention.

The term "design-enhancing mosaic" as used herein does not imply that the design is the mosaic itself, as is often the case with a typical mosaic made with typically opaque stones or other pieces of widely varying colors. The design-enhancing mosaic forming part of this invention is called a "mosaic" because of the preferred rather-random nature of the glass pieces themselves.

BRIEF DESCRIPTION OF THE DRAWINGS

The drawings illustrate a preferred embodiment including the above-noted characteristics and features of the invention. The invention will be readily understood from the descriptions and drawings. In the drawings.

DETAILED DESCRIPTION OF PREFERRED EMBODIMENTS

The figures and the descriptions below serve to describe details of the invention.

Figure 2:
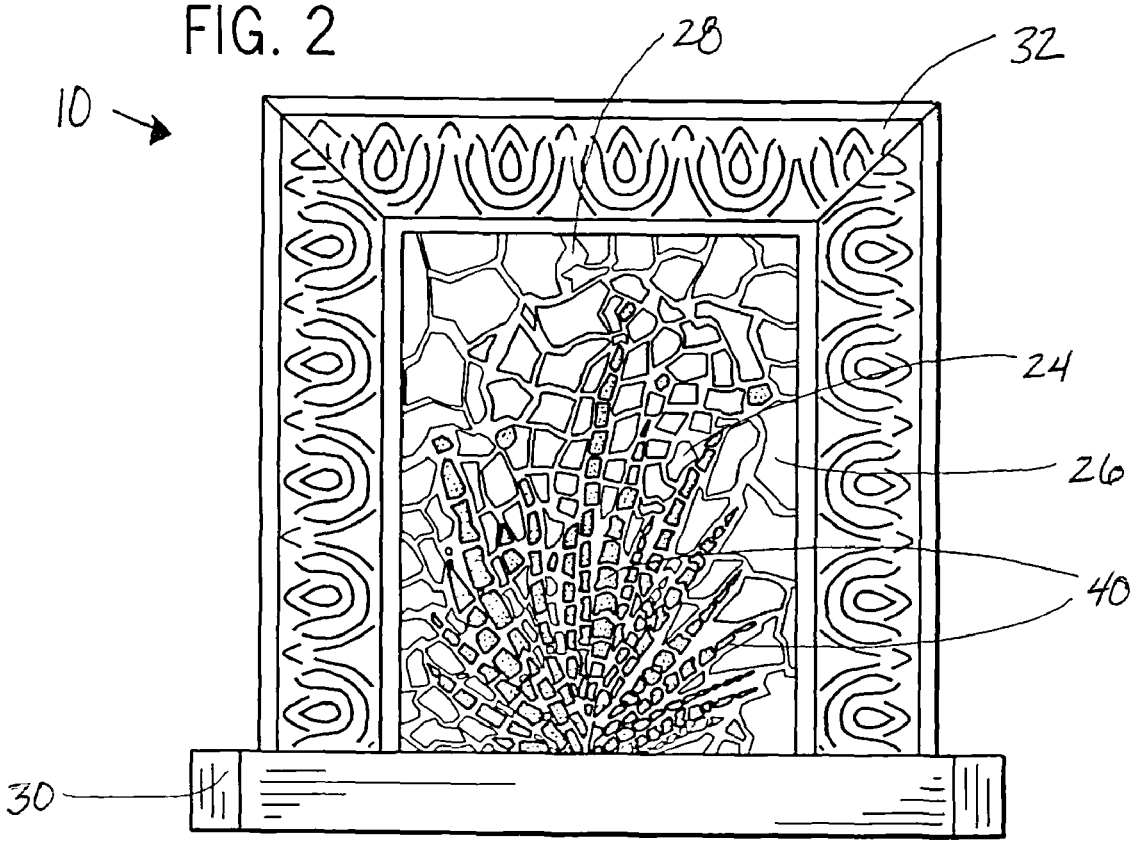
FIG. 2 is a front view of the device of FIG. 1 with flame design, lower edge support member and frame.
Figure 3:
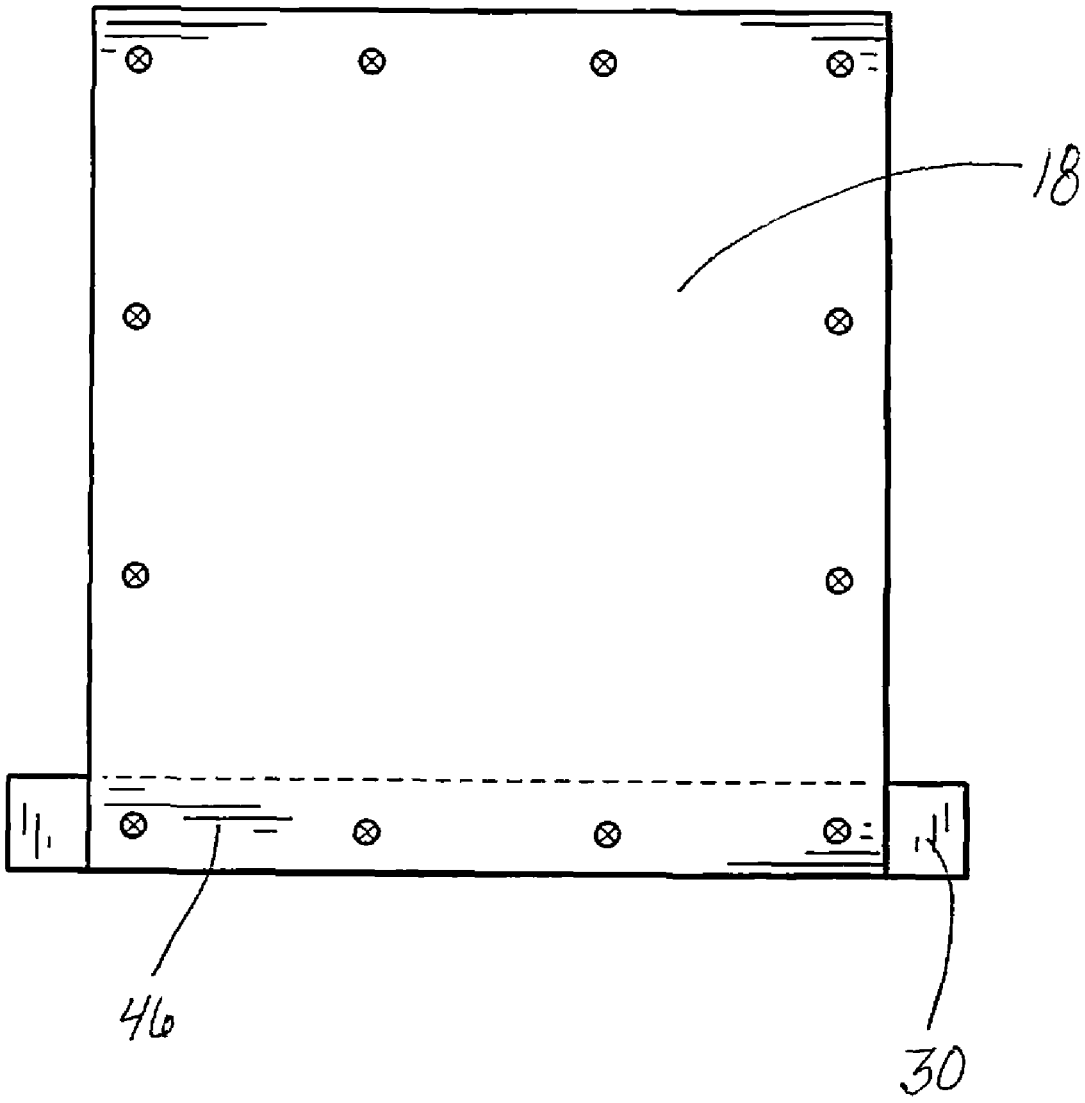
FIG. 3 is a back view of the device of FIG. 1 without the foam board.
Figure 4:
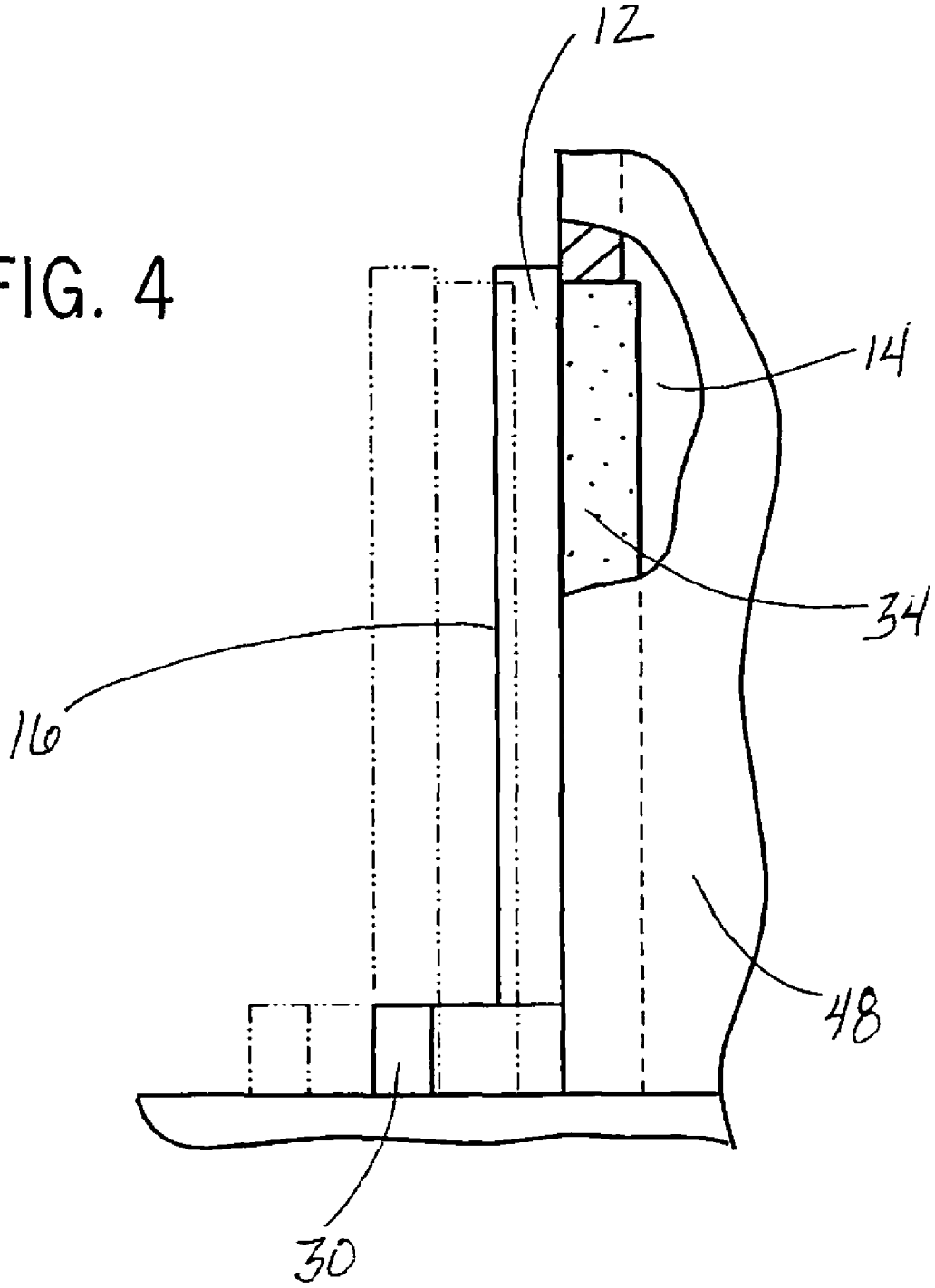
FIG. 4 is a side view of the device of FIG. 1 positioned in a fireplace opening.

FIGS. 1-9 illustrate decorative fireplace screen 10 for draft sealing of fireplace 48 having a fireplace opening 14. As seen in FIGS. 1-9 decorative fireplace screen 10 includes planar main member 12 sized to substantially cover fireplace opening 14. FIG. 4 illustrates fireplace screen being slid into fireplace opening 14 and substantially covering fireplace opening 14. Main member 12 has front and back surfaces 16, 18 as shown in FIGS. 1-9. Main member 12 is comprised of a substantially transparent material such as glass and transparent plastic materials. Wood or metal may also be used in part.

Figure 6:
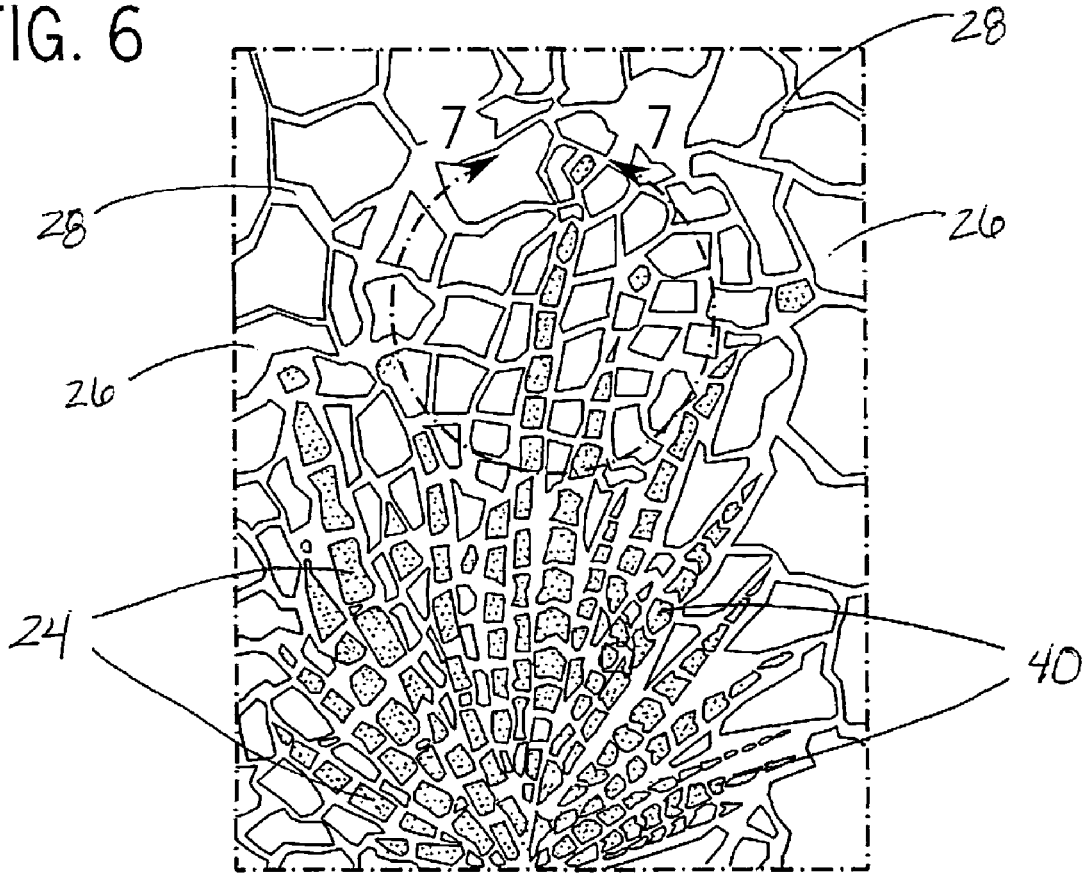
FIG. 6 is a front view of the device of FIG. 1 illustrating the mosaic.

Decorative design 20 is applied to front surface 16 of main member 12. A substantially clear adhesive layer 22 is applied onto decorative design 20 and a design-enhancing mosaic 24 of shattered-glass pieces 26 is adhered to adhesive layer 22 and substantially covers decorative design 20. As seen in FIG. 6 shattered glass pieces 26 are adhered to decorative design 20 to create mosaic 24 and grout 28 is applied between shattered glass pieces 26 which secures them in place.

Figure 7:
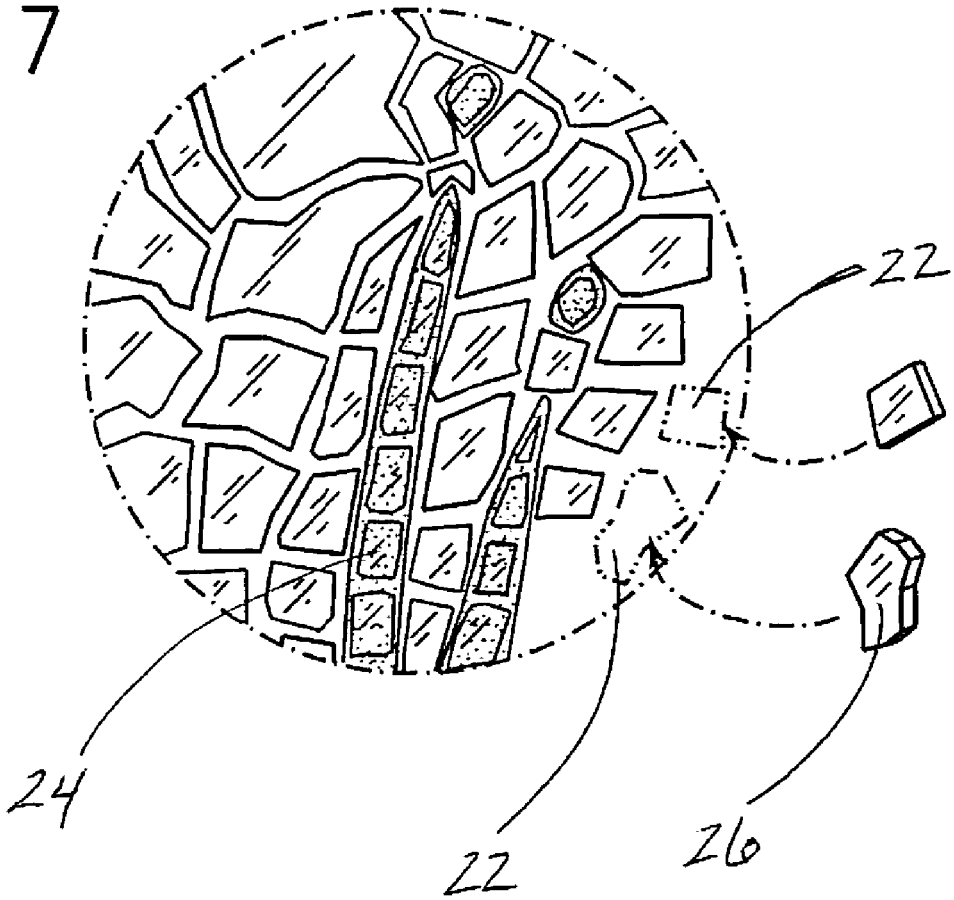
FIG. 7 is an enlarged portion of the fireplace screen as indicated in FIG. 6 taken in the direction of line 7-7.

As seen in FIG. 7 the shattered glass pieces 26 are applied and secured to decorative design 20 through the use of clear adhesive layer 22. It is preferred that clear adhesive layer 22 be a clear silicone adhesive.

Figure 1:
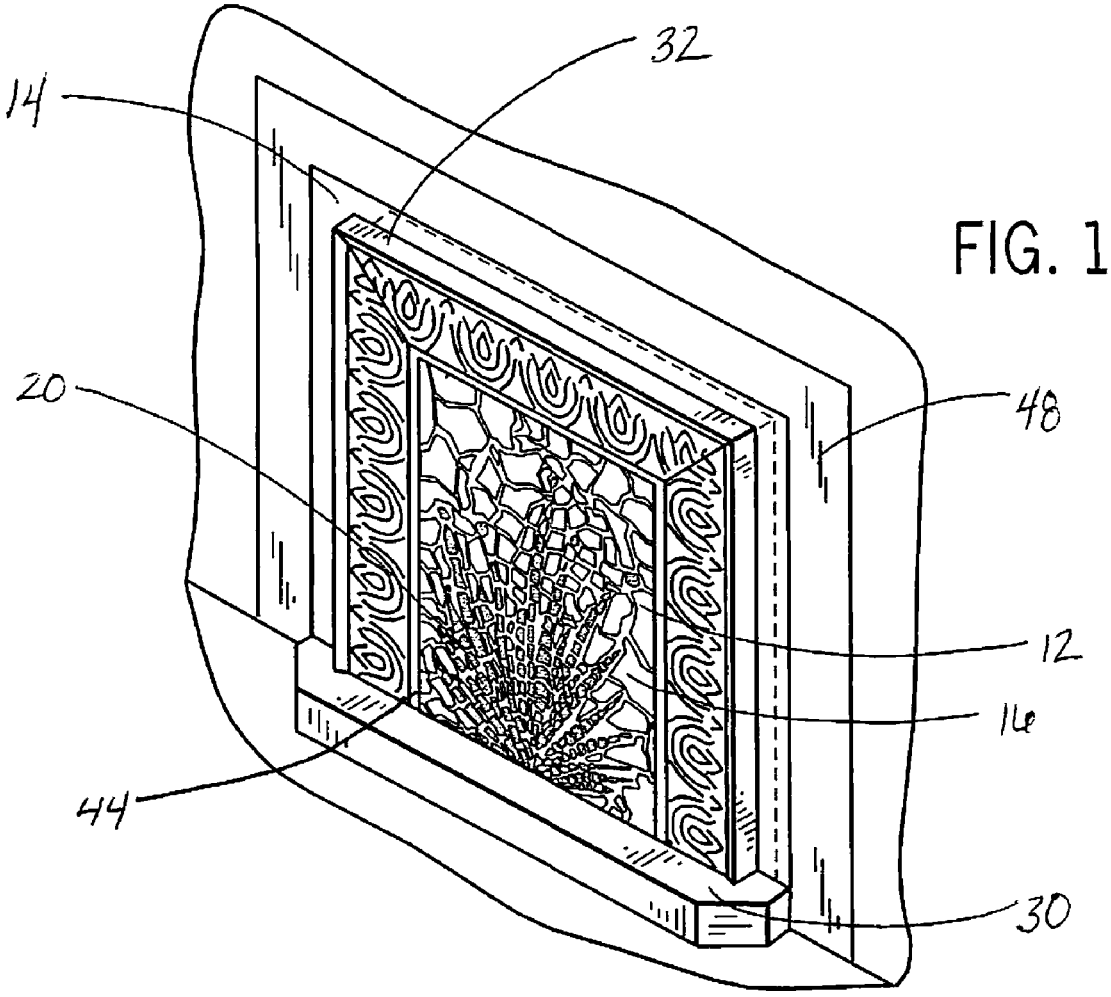
FIG. 1 is a front view of the device positioned in front of a fireplace opening.
Figure 9:
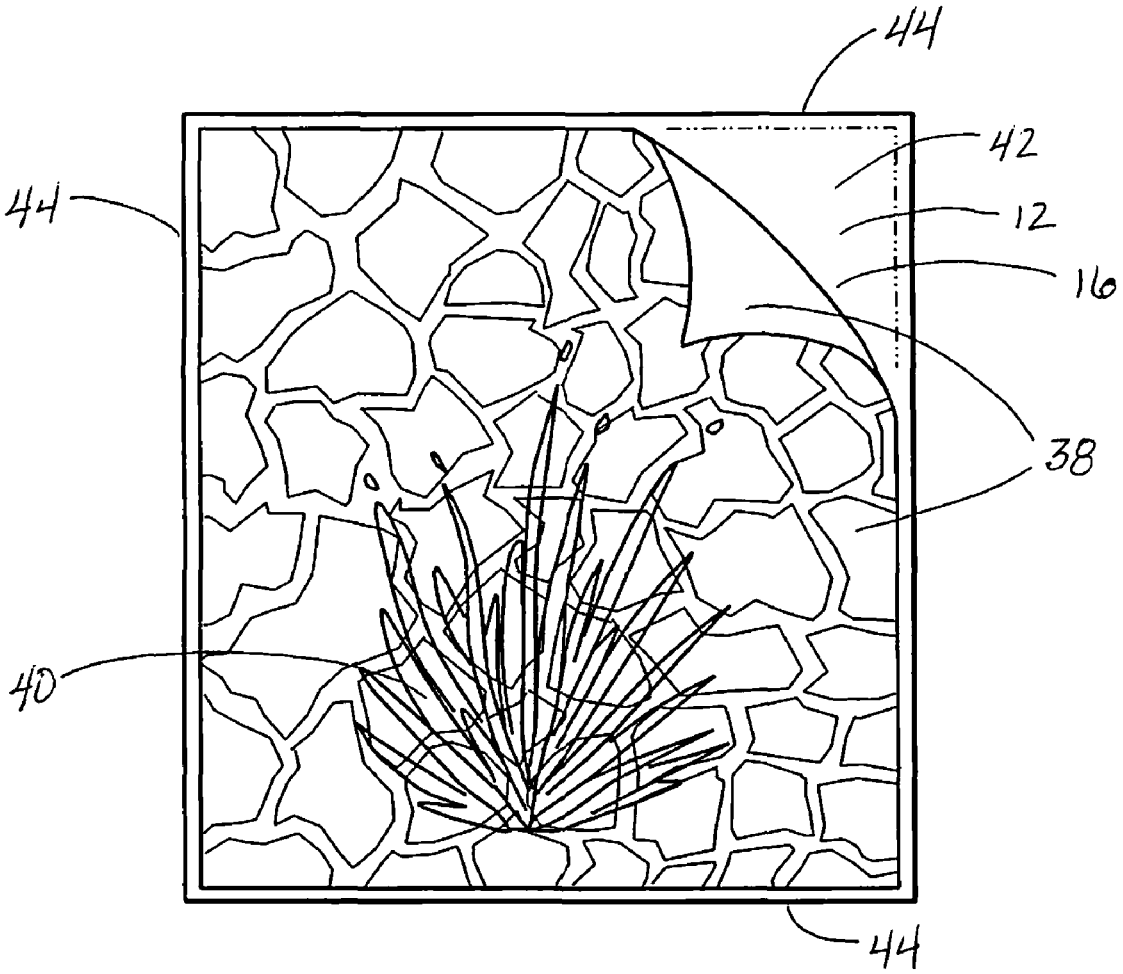
FIG. 9 is a front view of the device of FIG. 1 showing an alternate embodiment.

FIGS. 1-5 illustrate that decorative fireplace screen 10 has support member 30 along the lower edge 46 of main member 12 to support main member 12 of fireplace screen 10 in its placement at the fireplace opening 14. Frame 32 is also applied to front surface 16 of main member 12 about the edges 44 of main member 12 as seen in FIGS. 1-2 and 9.

Figure 5:
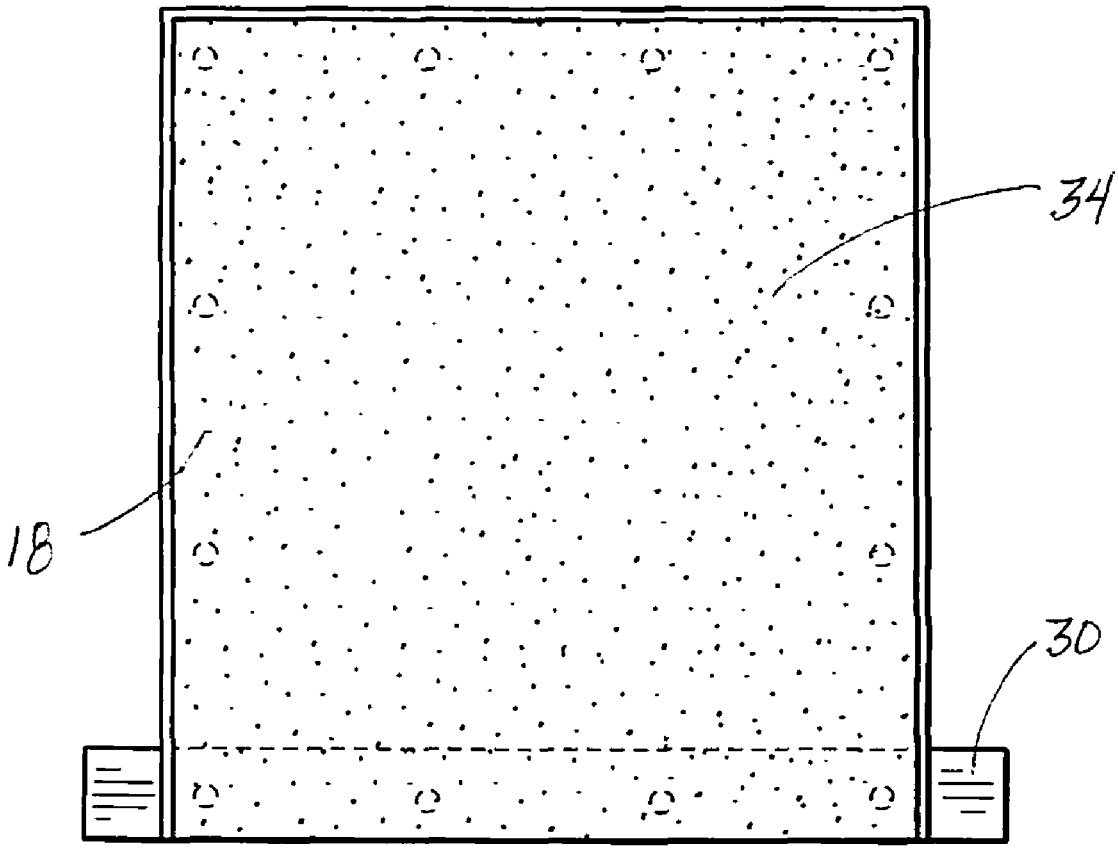
FIG. 5 is a back view of the device of FIG. 1 illustrating the foam board.

As illustrated in FIG. 5 foam board 34 is applied to back surface 18 of main member 12, thereby facilitating air-blocking and covering of the fireplace opening 14. FIG. 1 illustrates decorative fireplace screen 10 positioned in front of a fireplace 48 and specifically in front of fireplace opening 14. FIG. 2 illustrates decorative fireplace screen 10 not positioned in front of a fireplace opening 14. FIG. 3 shows the back surface 18 of main member 12 without foam board 34 attached to back surface 18. Foam board 34 is generally a polystyrene foam board and when decorative fireplace screen 10 is positioned in front of fireplace opening 14, foam board 34 helps to prevents air-blocking and drafts. FIG. 5 shows back surface 18 with foam board 34 attached. It is preferable that foam board 34 be a fire resistant insulation board.

Figure 8:
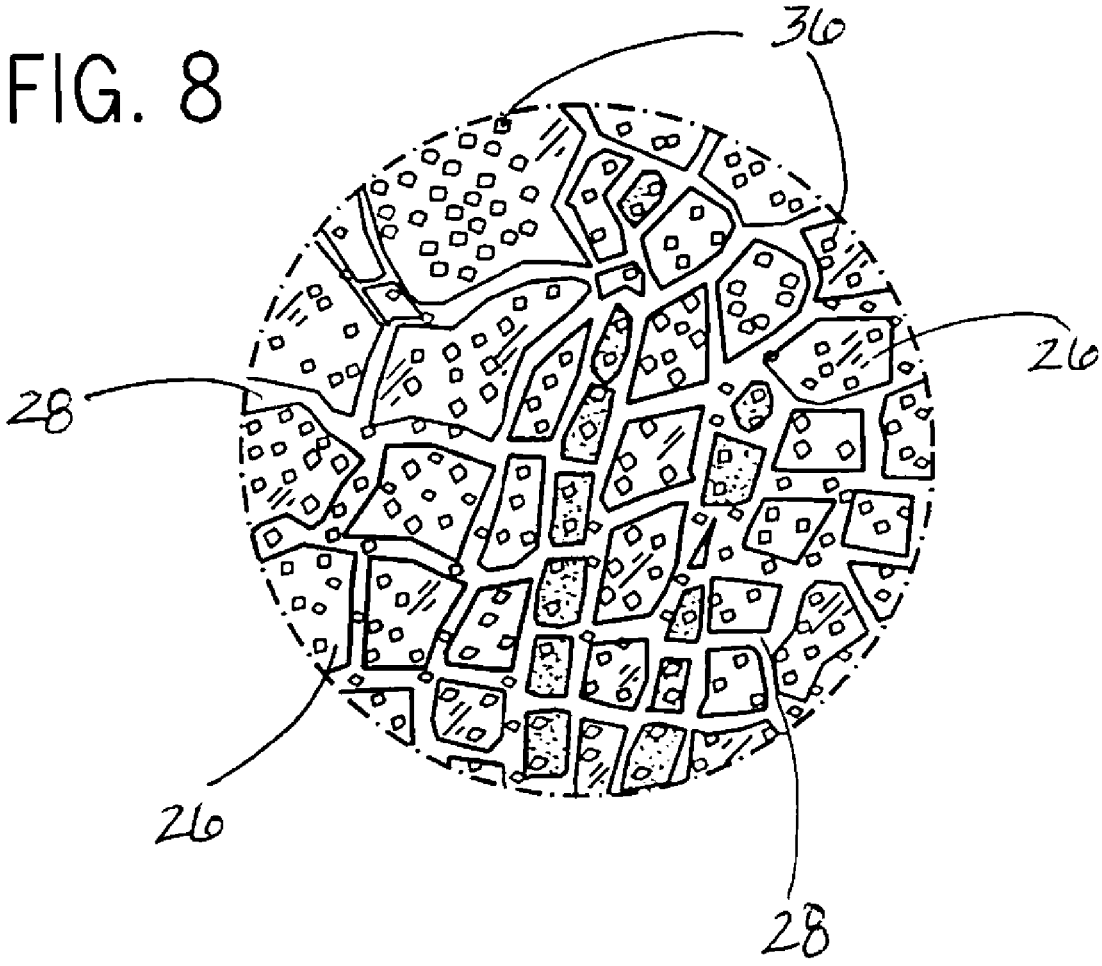
FIG. 8 is an enlarged portion of the fireplace screen as indicated in FIG. 6 taken in the direction of line 7-7 illustrating the mosaic with glitter.

FIG. 8 illustrates an enlarged view of mosaic 24 with glitter 36 selectively applied with respect to the design to highlight design features. Decorative design 20 can also be painted on front surface 16 of main member 12. Another embodiment includes decorative design 20 on a sheet which is applied onto front surface 16 of main member 12 as seen in FIG. 9.

It is preferable that decorative design 20 is a flame design 40. However, decorative design 20 can take numerous different artistic forms and shapes. Shattered glass pieces 26 can be either colored or non-colored glass.

The items used to manufacture a preferred embodiment of this invention include the following: wood, metal, plexiglass or glass for main member 12; wood, metal or frame molding members for frame 32 and for lower support member 30; construction glue adhesive or clear acrylic adhesive 22; ultra-fine glitter 36; shattered glass (clear or colored) 26; construction grout cement 28; 1¼-inch wood screws; 2½-inch wood screws; acrylic paint or oil paint and construction foam insulation board 34.

Manufacture of a preferred embodiment of the decorative fireplace screen 10 of this invention is now described:

After the main planar member 12 is cut to the specific desired fireplace-opening 14 size, it is painted (or printed), typically uniformly with a background color (preferably black). If a transparent main member 42 is used, it is not painted; this allows some light transmission through the finished product.

After the main member 12 has been made ready, an artistic design, such as the decorative flame design 40 shown in FIGS. 1-2, is applied to front surface 16 of main member 12. This may be done in a number of ways, reflecting the artistic creativity of the craftsman making the product—or even reflecting theme elements important to the ultimate buyer.

Glitter 36 is selectively applied to front surface 16 of main member 12 by sprinkling, adding a glistening look. The selective application of glitter 36 may be either after or before the painting of the artistic design—or even both before and after the painting of the artistic design.

Next, frame 32, itself preferably decorative, is attached by construction glue and then screwed down with 1¼-inch wood screws every three inches or so around outer edge of back surface 18 of main member 12. This stage of manufacture is seen in FIG. 3. Then lower support member 30 is attached by glueing with construction glue and using 2½-inch wood screws every three inches or so for added support, making sure that lower support member 30 is centered with respect to lower edge 46 and frame 32. This stage of manufacture is seen in FIG. 4. Lower edge 46, in addition to serving its purpose of supporting decorative fireplace screen 10 in its proper use position in front of a fireplace opening 14, also serves to complete the framing of decorative design 20.

The order of these frame 32 and lower support 30 attachment steps with respect to each other, and even with respect to the painting on (or other application) of the artistic design, is not of importance to the method of this invention.

Next, with main member 12 on a table or workbench in horizontal orientation with its front surface 16 up, a fairly substantial layer of clear acrylic adhesive 22 is applied over decorative design 20 and glitter 36 in order to prepare for application of the design-enhancing mosaic 24 of shattered-glass pieces 26. Such shattered-glass pieces 26 are placed, preferably in one-by-one fashion, onto the clear adhesive layer 22 until such pieces substantially cover decorative design 20. The entire exposed front surface 16 of main member 12 is covered, leaving only small spaces between the shattered glass pieces 26.

Grout 28 is then carefully applied to substantially fill in the gaps between the shattered glass pieces 26. This is done in a manner such that the shattered glass pieces 26 themselves are not covered on their frontally-exposed surfaces, in order that decorative design 20 below such shattered-glass 26 mosaic 24 may be seen. The structural combination of such shattered-glass 26 mosaic 24 and the design elements therebeneath give a very unique appearance to the product.

At some point in the manufacturing process, foam construction board 34 is attached to back surface 18 of main member 12, preferably over frame 32 member seen in the back view of FIG. 5. Foam board 34 may be secured in place with construction adhesive. Such foam board 34 facilitates sealing of fireplace opening 14; i.e., it allows some degree of blocking of air movement into and out of the fireplace opening 14.

The completed embodiment of the decorative fireplace screen 10 of this invention as just described is seen best in FIG. 1. FIGS. 1-2, and 6-8 show shattered-glass pieces 26 of widely varying sizes and shapes and grout 28 that has been placed between such shattered glass pieces 26.

Decorative fireplace screen 10 of this invention can be used for purposes other than fireplace screening. For example, it can be used as a decorative screen over any opening in an exterior or interior wall. And, it can form a unique privacy screen for any number of purposes.

While the principles of the invention have been shown and described in connection with specific embodiments, it is to be understood that such embodiments are by way of example and are not limiting.

The invention claimed is:

1. A decorative fireplace screen for draft sealing of a fireplace having a fireplace opening with a horizontal foresurface in front of the opening, comprising:

a planar main member sized to substantially cover the fireplace opening, the main member having front and back surfaces, a frame applied to the front of the main member about the edges thereof and a support member along the lower edge to rest on the foresurface and support the main member in its placement at the fireplace opening;

a two-dimensional, complete-in-itself graphical decorative work applied to the main member;

a substantially clear adhesive layer applied directly onto and over the decorative work;

a design-enhancing mosaic of flat, irregularly-shaped shattered-glass pieces applied directly onto and over the adhesive layer and substantially covering the decorative work while allowing substantially full visibility of the decorative work directly through and as enhanced by the shattered-glass pieces;

grout applied between the shattered glass pieces further securing them in place; and an insulation member applied at the back surface of the main member in position to facilitate air-blocking covering of the fireplace opening by the screen.

2. The decorative fireplace screen of claim 1 wherein the insulation member is a foam board applied to the back surface of the main member.

3. The decorative fireplace screen of claim 1 further including glitter selectively applied with respect to the design to highlight design features.

4. The decorative fireplace screen of claim 1 wherein the decorative work is painted on the front surface of the main member.

5. The decorative fireplace screen of claim 1 wherein the decorative work is on a sheet applied onto the front surface of the main member.

6. The decorative fireplace screen of claim 1 wherein the decorative work is a flame design.

7. The decorative fireplace screen of claim 1 wherein the shattered glass pieces are of non-colored glass.

8. The decorative fireplace screen of claim 1 wherein the main member is of a substantially transparent material.

9. The decorative fireplace screen of claim 8 wherein the main member is of a material selected from glass and transparent plastic materials.

10. A method of making a decorative fireplace screen for draft sealing of a fireplace having a fireplace opening with a horizontal foresurface in front of the opening, comprising:

providing a planar main member sized to substantially cover the fireplace opening, the main member having front and back surfaces, a frame applied to the front of the main member about the edges thereof and a support member along the lower edge to rest on the foresurface and support the main member in its placement at the fireplace opening, the main member being of a substantially transparent material to facilitate transmission of light therethrough from behind the screen;

applying a two-dimensional, complete-in-itself graphical decorative work to the main member;

applying a substantially clear adhesive layer applied directly onto and over the decorative work;

placing flat, irregularly-shaped shattered-glass pieces directly onto the adhesive layer to adhere a design-enhancing mosaic of individual glass pieces over and substantially covering the decorative work while allowing substantially full visibility of the decorative work directly through and as enhanced by the shattered-glass pieces; and applying grout between the shattered glass pieces.

11. The method of claim 10 further including applying an insulation member at the back surface of the main member in position to facilitate air-blocking covering of the fireplace opening by the screen.

12. The method of claim 10 further including selectively applying glitter with respect to the design to highlight design features.

13. The method of claim 10 wherein the applying of the decorative work is by painting.

14. The method of claim 10 wherein the applying of the decorative work is by applying a sheet onto the front surface of the main member.

15. The method of claim 10 wherein the shattered glass pieces are of non-colored glass.

16. The method of claim 10 wherein the main member is of a substantially transparent material.

17. A decorative screen comprising:

a planar main member, the main member being of a substantially transparent material to facilitate transmission of light therethrough from behind the screen, the main member having:

front and back surfaces;

a frame applied to the front of the main member about the edges thereof; and a support member along the lower edge of the main member to support the main member in an upright orientation;

a two-dimensional, complete-in-itself graphical decorative work applied to the main member;

a substantially clear adhesive layer applied directly onto and over the decorative work;

a design-enhancing mosaic of flat, irregularly-shaped shattered-glass pieces applied directly onto and over the adhesive layer and substantially covering the decorative work while allowing substantially full visibility of the decorative work directly through and as enhanced by the shattered-glass pieces;

grout applied between the shattered glass pieces further securing them in place; and an insulation member applied at the back surface of the main member in position to facilitate air-blocking covering of a fireplace opening by the screen.

18. The decorative screen of claim 17 further including glitter selectively applied with respect to the design to highlight design features.

19. The decorative screen of claim 17 wherein the decorative work is painted on the front surface of the main member.

20. The decorative screen of claim 17 wherein the decorative work is on a sheet applied onto the front surface of the main member.

21. The decorative screen of claim 17 wherein the shattered glass pieces are of non-colored glass.

22. The decorative screen of claim 17 wherein the main member is of a material selected from glass and transparent plastic materials.

23. The decorative screen of claim 17 wherein the screen is a fireplace screen, whereby when the fireplace is in use, light from the fire is transmitted through the screen.

24. The decorative screen of claim 23 wherein the screen is configured and arranged for draft sealing of the fireplace opening.

* * * * *